US006991705B2

(12) United States Patent
Leino et al.

(10) Patent No.: US 6,991,705 B2
(45) Date of Patent: Jan. 31, 2006

(54) PROCESS FOR STABILIZING THE PH OF A PULP SUSPENSION AND FOR PRODUCING PAPER FROM THE STABILIZED PULP

(75) Inventors: Hannu Juhani Leino, Espoo (FI); Anna Linnea Holmberg, Lidingö (SE)

(73) Assignee: Aga Aktiebolag, Lidingo (SE)

( * ) Notice: Subject to any disclaimer, the term of this patent is extended or adjusted under 35 U.S.C. 154(b) by 0 days.

(21) Appl. No.: 09/445,710

(22) PCT Filed: Jun. 12, 1998

(86) PCT No.: PCT/FI98/00509

§ 371 (c)(1),
(2), (4) Date: Mar. 13, 2000

(87) PCT Pub. No.: WO98/56988

PCT Pub. Date: Dec. 17, 1998

(65) Prior Publication Data

US 2003/0150570 A1 Aug. 14, 2003

(30) Foreign Application Priority Data

Jun. 13, 1997 (FI) ..... 972522

(51) Int. Cl.
*D21H 17/64* (2006.01)
*D21H 17/73* (2006.01)
*D21C 9/00* (2006.01)

(52) U.S. Cl. ..... 162/9; 162/63; 162/90; 162/181.4; 162/182; 162/183; 162/158

(58) Field of Classification Search ..... 162/158, 162/78, 76, 90, 63, 9, 181.2, 181.4, 182–184
See application file for complete search history.

(56) References Cited

U.S. PATENT DOCUMENTS

| | | | | |
|---|---|---|---|---|
| 5,378,322 | A | 1/1995 | Hornsey | 162/158 |
| 6,086,714 | A * | 7/2000 | Plaskon et al. | 162/63 |
| 2003/0150570 | A1 * | 8/2003 | Leino et al. | 162/9 |
| 2004/0238455 | A1 * | 12/2004 | Leino | 210/743 |

FOREIGN PATENT DOCUMENTS

| | | | |
|---|---|---|---|
| CA | 1288906 | | 9/1991 |
| EP | 0 281 273 | * | 9/1988 |
| GB | 815247 | | 6/1959 |
| WO | WO 8804705 A1 | * | 6/1988 |
| WO | WO 90/09483 | | 8/1990 |

OTHER PUBLICATIONS

Ostberg et al., 5th Internatl. Conf. on New Avail. Technique-Stockholm, "Use of Carbon Dioxide in the Production of Sulfate Pulp," Jun. 1996, pp. 508-515.
Gullichsen et al. (eds.), In: Papermaking Science & Technology, "Papermaking Chemistry," book 4, 1999, p. 192.

* cited by examiner

*Primary Examiner*—José A. Fortuna
(74) *Attorney, Agent, or Firm*—Pearne & Gordon LLP

(57) ABSTRACT

The invention relates to a process for stabilizing the pH of a pulp suspension with buffering agents and to a process for producing paper from a stabilized pulp suspension. The alkalinity of the pulp suspension is increased by a combination of an alkali metal hydroxide feed and a carbon dioxide feed. Said feeds provide a significant buffering effect which stablilizes the pH of said pulp suspension for the paper making process.

26 Claims, No Drawings

PROCESS FOR STABILIZING THE PH OF A PULP SUSPENSION AND FOR PRODUCING PAPER FROM THE STABILIZED PULP

The invention relates to a process for stabilizing the pH of a paper making pulp suspension with buffering agents and to a process for producing paper from such a stabilized pulp suspension.

During the last ten to fifteen years many paper makers have converted their processes from acidic to neutral pH for a number of reasons, e.g. to gain increased strength and to be able to use calcium carbonate, $CaCO_3$, as a filler. The expression "neutral pH" corresponds in these processes to a pH in the short circulation of approximately 7–8.5, most preferably 7–8. This applies to paper produced from chemical, mechanical and recycled pulp, bleached or unbleached.

If the paper making pulp is acidic when entering the stock preparation and the short circulation is run at a neutral or alkaline pH, the traditional way of raising and controlling the pH is to add sodium hydroxide, NaOH. NaOH is, however, a very strong base, which means that only small amounts are needed for pH adjustments. Any over-dosage will cause a too big pH increase, which means that it is difficult to perform the pH adjustment in a controlled way. This is due to the low inherent buffering ability of a pulp suspension. The paper maker could end up in a situation with varying pH of the entering pulp, which has a negative impact on paper quality and paper machine runnability.

Through the stock preparation and the short circulation a number of paper chemicals and dilution waters are added, some of which are acidic and therefore decrease the pH of the pulp. The paper maker could therefore end up with a too low pH in the short circulation and would be once again forced to pH adjust using NaOH. The pH may also change at refining or in storage towers.

If the paper making pulp is alkaline instead when entering the stock preparation and if the short circulation is run at a neutral or alkaline pH, there is naturally no need to use any NaOH for pH control. The paper maker must however make sure that the pH is high enough to avoid ending up with too low a pH after addition of acidic paper chemicals.

In the prior art one way of avoiding ending up with too low pH values has been to add dissolved sodium bicarbonate, $NaHCO_3$, to the pulp. The $NaHCO_3$ dissociates in the pulp suspension forming bicarbonate ions, $HCO_3^-$, which have a buffering effect and therefore counteract any pH decrease. $NaHCO_3$ is a solid powder, which is generally supplied in so called big-bags, and the paper mill needs space for handling, equipment for dissolving and tanks for storage. The $NaHCO_3$ is messy to work with, when in contact with moisture or water.

In the non-acidic sizing of paper with alkylketene dimers bicarbonate ions have been used to catalyze the reaction between the alkylketene dimers and the cellulose. According to U.S. Pat. No. 5,378,322 the bicarbonate ions may be generated by dissociation of carbon dioxide $CO_2$ in the aqueous pulp.

Carbon dioxide is a gas, which easily dissolves under alkaline conditions, e.g. in water or a pulp suspension forming carbonic acid and/or bicarbonate ions according to the reaction:

$$CO_2+H_2O \Leftrightarrow H_2CO_3 \Leftrightarrow H^++HCO_3^-$$

At a high pH, especially greater than 10, the predominant reaction is $$CO_2+OH^- \Leftrightarrow HCO_3^-$$

In the recycling of gypsum-containing waste or broke paper the accumulation of calcium sulfate poses a problem since the solubilized calcium sulfate may precipitate and disturb the paper making process. According to U.S. Pat. No. 5,262,006 this problem may be overcome by adding carbonate ions and/or bicarbonate ions to the aqueous pulp suspension and by adjusting the pH to an alkaline value to precipitate the calcium as calcium carbonate. The bicarbonate ions may be created in situ for example by first adding a suitable soluble metal hydroxide and then adding carbon dioxide. According to the Patent, the calcium carbonate generation from calcium sulfate with carbon dioxide requires a close control of the pH since carbon dioxide has the effect of lowering the pH so that there is a risk of the pH becoming too low for the carbonation process.

Carbon dioxide has also been used for the pH control of pulp suspensions, for instance, in a process described in EP Patent 0 281 273, wherein gaseous carbon dioxide is introduced to adjust and maintain the pH at a value which is preferably between 7.0 and 5.5.

Thus, in the prior art carbon dioxide has been used to create bicarbonate ions for its catalyzing, carbonating or pH lowering effect. However, a paper maker also has the need to obtain a stable pH so that chemical additions and various processing steps do not cause an unwanted fluctuation of the pH.

An object of the present invention is thus to provide a pH stabilization of aqueous pulp suspensions.

Another object of the invention is to provide a paper making pulp suspension having an increased alkalinity, i.e. a resistance to pH change.

A further object of the invention is to provide a technically advantageous process for buffering a pulp suspension.

An object is also to provide a pulp suspension having a controlled pH which is maintained at a desired level.

An object of the invention is also to provide a process for producing paper from a pulp suspension having a stabilized pH.

The invention according to the present application is defined in the appended claims, the contents of which are included herein by reference.

Consequently, the present invention relates to a process for stabilizing the pH of a pulp suspension, wherein the alkalinity of a paper making pulp suspension is increased by adding thereto a combination of an alkali metal hydroxide feed and a carbon dioxide feed which feeds substantially counter each other's pH changing effect, said feeds being provided in an amount sufficient to achieve a significant buffering effect of said pulp suspension for paper making.

The feeding of a hydroxide and carbon dioxide in substantially countering amounts increases the level of alkalinity forming ions in the suspension without actually affecting its pH. Increasing the alkalinity stabilizes the suspension against pH fluctuations caused by subsequent additions of acidic or basic fluids and provides a stable pH throughout the succeeding steps.

Alkalinity is a measurement of "acid resistance", i.e. the content of buffering ions in a liquid or pulp suspension, which counteracts pH decrease at addition of hydrogen ions, $H^+$. One way of expressing alkalinity is the amount of $HCO_3^-$ and $CO_3^{2-}$ ions in grams per liter. When a combination of hydroxide and carbon dioxide is used according to the present invention, the alkalinity of the pulp suspension is raised, thus creating larger "acid resistance".

The hydroxide used according to the invention should preferably be added prior to the addition of the carbon dioxide to ensure that the carbon dioxide is added under alkaline conditions.

The "amount sufficient to achieve a significant buffering effect" should be taken as meaning an amount providing a substantial and recognizable buffering effect in the pulp suspension. The amount normally varies depending on the characteristics of the pulp and on the conditions of treatment. A person skilled in the art will be able to calculate the required amount based on his general knowledge or by simple tests made on the actual pulp suspension, as indicated, for example in Example 9 of this specification.

Typically the amount of NaOH in the buffering combination will be between about 0.5 and 5 kg NaOH/ton dry cellulose and the amount of carbon dioxide in said combination will be between about 0.5 and 5 kg $CO_2$/ton dry cellulose. A typical buffering combination would include about 2 to 3 kg of NaOH and $CO_2$ per ton of dry cellulose. It is within the scope of the present invention to use more or less than the above mentioned amounts of both components, but in general it will be uneconomical to use more than what is required for a desired buffering action.

It is clear that the excess of either NaOH or $CO_2$ which is additionally used for pH adjusting purposes may significantly exceed the above amounts which provide the buffering effect.

The buffering effect obtained by the addition of NaOR and $CO_2$ in this way corresponds to the one obtainable by an addition of dissolved $NaHCO_3$ but it has the advantage that the space consuming and messy handling of solid $NaHCO_3$ is avoided. Sodium hydroxide, on the other hand, is a chemical which is abundantly available in the paper mill since it is used for many other purposes. Carbon dioxide gas may be generated on site or may be bought as desired. Feeding of carbon dioxide into the suspension is technically clean and easy.

A further advantage resides in that the hydroxide and carbon dioxide used according to the present invention may serve the dual purpose of increasing the alkalinity and of adjusting the pH. Thus, according to a preferred embodiment of the invention, the pH of said pulp suspension is increased by adding an excess of alkali metal hydroxide such as aqueous sodium hydroxide or decreased by adding an excess of carbon dioxide.

The carbon dioxide is preferably in gaseous form, although it may be added as an aqueous liquid by dissolving gaseous or solid carbon dioxide in water. The hydroxide and carbon dioxide may be combined prior to feeding to the pulp suspension although it is preferred to feed them directly into the pulp circulation system such as to a pipe leading to a stock preparation tank.

The pulp suspension is preferably buffered by said combination to a pH between about 7 and 9.

According to the preferred embodiment of the invention the alkalinity of the pulp suspension is increased by providing a substantially equal molar amount of alkali metal hydroxide and dissolved carbon dioxide, said amount being sufficient to provide a significant buffering effect at about pH 8.

The pulp suspension may be bleached or unbleached chemical or mechanical pulp although the preferred pulp is bleached chemical pulp.

Calcium carbonate may advantageously be used as a filler for the pulp, since the stabilized pH will ascertain that the filler remains in solid form in the suspension. A fluctuation of the pH down to 6 or 5.5, for instance due to an inflow of circulating white water at such a pH, might dissolve the carbonate filler. Such an undesirable effect will be effectively prevented by the buffering action of the present invention.

The present invention also relates to a process for producing paper, said process comprising the steps of providing a paper making pulp suspension;

increasing the alkalinity of said pulp suspension by adding thereto a combination of an alkali metal hydroxide feed and a carbon dioxide feed which feeds substantially counter each others pH changing effect, said feeds being provided in an amount sufficient to achieve a substantial buffering effect of said pulp suspension for paper making;

optionally adjusting the pH of said pulp suspension to a desired value between 7 and 9 by adding an alkaline agent such as NaOH or an acidic agent such as $CO_2$;

forming said pulp suspension into a web; and drying said web to form paper.

The production of paper according to the present invention is performed in a conventional way in all other respects except for the increase of the alkalinity of the pulp prior to the short circulation. Such paper making processes are well known in the art and it is not considered necessary to describe them here in any greater detail.

The invention will now be illustrated with a few examples which should not be considered as limiting the invention in any way.

EXAMPLE 1

(Reference Example)

In a partly integrated paper mill bales of fully bleached kraft market pulp are introduced into a pulp slusher. The pH in the slusher is adjusted with aqueous NaOH to a pH of approximately 11.

After slushing, paper making chemicals and dilution water having an acidic effect are added to the slushed pulp suspension. As a consequence of this, the pH of the pulp suspension decreases from pH 11 to about pH 6.5–6.8. This pH is too low for the short circulation, which is run at a pH level of 7–7.5. Thus, the pH is again adjusted by an addition of aqueous NaOH.

Because of the strong basic action of NaOH it is difficult to achieve an exact pH control in this way. Over-dosing leads to a too high pH.

EXAMPLE 2

The process of Example 1 is changed in order to improve the situation, so that a combination of NaOH and $CO_2$ is added to the pulp slusher. The amount of NaOH added to the suspension is substantially increased compared to the process of Example 1. A countering amount of $Co_2$ is added to provide a pH of approximately pH 9.

After slushing, the same paper chemicals as in Example 1 are added to the slushed pulp suspension. Because of the buffering effect of the combined NaOH and $CO_2$, the acidic additions lower the pH only to pH 7.2. This is a suitable pH for the short circulation and there is no need for any pH control using NaOH.

EXAMPLE 3

(Reference Example)

In a paper mill a kraft pulp suspension having a pH of 5.1 is fed to a storage tower. Prior to the entry into the tower, the pH of the pulp suspension is adjusted to pH 8 by an addition of aqueous NaOH into the pipe leading to the tower. The pulp suspension is fed from the storage tower to a refiner. At refining the pH decreases to about pH 6.

The low pH causes problems in the subsequent sizing of the pulp.

EXAMPLE 4

The process of Example 3 is repeated with the exception that instead of feeding only the required amount of NaOH into the pulp suspension, an excess of NaOH is fed first into the pipe followed by feeding gaseous $CO_2$ into the pipe counteracting the excess NaOH. The resulting suspension again has a pH of 8 when entering the storage tower.

From the storage tower the pulp is fed to the refiner. At refining the pH remains at about pH 8 and there are no problems at sizing.

EXAMPLE 5

In a laboratory trial a pulp suspension having a pH of 5.1 was used. The pH of the pulp suspension was adjusted to pH 8 by using a) only NaOH and b) by using an excess of NaOH in combination with $CO_2$. The buffering effect of the suspension was tested with a strong acid (alum, pH 3.0).

The results are shown in Table 1 below.

TABLE 1

| | pH[1] | NaOH (ml) | $CO_2$ (g) | pH[2] | alum (ml) | pH[3] |
|---|---|---|---|---|---|---|
| a) (NaOH) | 5.1 | 2 | — | 8.0 | 1 | 6.4 |
| b) (NaOH + $CO_2$) | 5.1 | 3 | 1 | 8.0 | 1 | 7.9 |

[1]the pH of the initial pulp suspension
[2]the pH after addition of NaOH/NaOH + $CO_2$
[3]the pH after addition of acid In the above process 1 ml of the aqueous NaOH corresponds to about 2.5 kg/ton cellulose calculated on the dry weight basis; 1 g of $CO_2$ similarly corresponds to about 2.5 kg/ton cellulose; and 1 ml of alum corresponds to about 2.8 kg/ton cellulose.

The above results clearly show that the addition of countering amounts of NaOH and $CO_2$ stabilize the pH of the pulp suspension.

EXAMPLE 6

(Reference Example)

A pulp suspension was stored in a pulp storage tank in a pulp mill at a pH of 5.5 to 6. The pulp was fed at this pH at a consistency of 3 to 4% to the paper mill via a press which increased the consistency to about 10%. The pulp was fed at this consistency to the paper mill storage tank at a pH of 5.5 to 6.

White water from the paper machine was fed to the storage tank at a pH of 7.5 to 8. The paper was produced with $CaCO_3$ as filler. Some of the filler circulated with the white water to the storage tank. When entering the storage tank the $CaCO_3$ in the white water dissolved as it met the pulp suspension at pH 5.5 to 6.

The dissolving of the $CaCO_3$ caused loss of filler and in addition thereto the calcium ions increased the hardness of the water and caused precipitations at unwanted positions.

From the storage tank the suspension was fed to a refiner. For improving the refining the pH of the pulp suspension was adjusted to 7.5 with NaOH before the refiner. Careful control of the NaOH feed was required to avoid dosing too much or too little.

In the refiner the pH decreased to 6 to 6.5 which meant increased energy consumption at refining. The pH was too low for the sizing. Thus, the pH had to be adjusted again for the sizing.

EXAMPLE 7

(Reference Example)

The process of Example 6 was repeated with the exception that aqueous $NaHCO_3$ was fed to the paper mill storage tank to obtain the desired pH of about 7.5 to 8. The $CaCO_3$ in the white water was not dissolved and the problem with filler loss was resolved.

The pH of the feed to the refiner was about 7.5 and no NaOH was fed to the suspension. However, in the refiner the pH decreased as before and a pH adjustment with NaOH was required for sizing.

EXAMPLE 8

The process of Example 6 was repeated with the exception that NaOH and $CO_2$ were fed to the pipe leading to the paper mill storage tank. The pH was adjusted to 8 and no loss of filler occurred in the storage tank.

The pH of the feed to the refiner was about 8 and no NaOH was fed to the suspension. At refining the alkalinity of the suspension counteracted the pH lowering effect in a sufficient degree to retain the pH at 7.5 to 8.

There was no need for a pH adjustment for sizing. The pulp was used for the production of paper with an excellent result.

EXAMPLE 9

A pulp suspension having a 10% consistency and a pH of 7.4 was divided into two lots, Pulp 1 and Pulp 2, respectively, weighing 2030 g each. The pH of the pulp suspension was adjusted on one hand with sulfuric acid (a 10% by weight aqueous solution of $H_2SO_4$) and on the other hand with gaseous carbon dioxide and a combination of 1 M sodium hydroxide and carbon dioxide gas.

The pH of Pulp 1 was adjusted to 6.2 with said sulfuric acid. The pH of Pulp 2 was adjusted to 6.2 by adding 15 ml sodium hydroxide and 1.02 g of carbon dioxide. The resulting pulp suspensions were titrated with 10% sulfuric acid to study their respective resistance to pH change.

The results are indicated in Table 2 below.

TABLE 2

| Titration $H_2SO_4$ (kg/t) | pH Pulp 1 | pH Pulp 2 |
|---|---|---|
| 0 | 6.22 | 6.20 |
| 1.4 | 6.18 | 6.20 |
| 2.4 | 6.10 | 6.21 |
| 4.7 | 6.03 | 6.17 |
| 10.6 | 5.82 | 6.12 |

The sulfuric acid in Table 2 is indicatied in kg of 100% $H_2SO_4$ per ton of dry cellulose.

For the above adjustment of the pH and alkalinity of Pulp 2, NaOH was added in an amount of 2.9 kg/ton cellulose and $CO_2$ was used in an amount of 5.1 kg/ton cellulose. The $CO_2$ was used both for pH adjustment and to counter the addition of sodium hydroxide.

The test shows that fairly small amounts of a combination of sodium hydroxide and carbon dioxide provides an effective buffering action. The above final pH of 6.12 would render Pulp 2 fully useful for papermaking purposes, while the final pH of Pulp 1 would be too low.

It is evident that the invention may be varied in a great number of ways which are obvious to those skilled in the art without deviating from the scope of the claims.

The invention claimed is:

1. A process for stabilizing the pH of a pulp suspension at a desired pH level, comprising increasing the buffering ability of said pulp suspension by adding thereto, in the stock preparation of a paper machine in a paper mill, a combination of an alkali metal hydroxide feed and a carbon dioxide feed, which cooperate to increase the pH of said pulp suspension and to otherwise only counter each other's pH adjusting effects without further separate uses of their respective intermediate pH adjusting effects, each of said feeds being added in an amount greater than what would be required to only adjust the pH of the suspension to the desired pH level, said feeds being provided in an amount sufficient to achieve a significant buffering effect of said pulp suspension and to increase the pH of said pulp suspension and maintain the pH at a desired level from the addition of the feeds throughout the short circulation and formation of the paper on the paper machine.

2. Process according to claim 1, characterized in that the pH of said pulp suspension is increased to a pH between about 7 and 9.

3. Process according to claim 1, characterized in that said alkali metal hydroxide is aqueous sodium hydroxide and said carbon dioxide is gaseous carbon dioxide.

4. Process according to claim 1, characterized in that said alkali metal hydroxide is fed to said pulp suspension prior to the feeding of said carbon dioxide.

5. Process according to claim 1, characterized in that the buffering ability of said pulp suspension is increased by providing a substantially equal molar amount of alkali metal hydroxide and dissolved carbon dioxide, said amount being sufficient to provide a significant buffering effect at about pH 8.

6. Process according to claim 1, characterized in that said pulp suspension is chemical or mechanical pulp.

7. Process according to claim 6, characterized in that said pulp suspension is a bleached chemical pulp.

8. Process according to claim 1, characterized in that said pulp suspension contains calcium carbonate filler.

9. Process according to claim 1, characterized in that said alkali metal hydroxide and carbon dioxide feeds are added to said pulp suspension flowing in a pipe leading to a stock preparation tank.

10. Process according to claim 1, characterized in that said alkali metal hydroxide and said carbon dioxide are combined prior to feeding to the pulp suspension.

11. Process according to claim 1, wherein said paper making pulp suspension is provided by adding water to bales of pulp or adding water to pulp of increased consistency coming from a pulp mill.

12. Process according to claim 1, wherein said amount of said alkali metal hydroxide feed, which is sufficient to achieve a substantial buffering effect, is a sodium hydroxide feed of from about 0.5 kg/ton to about 5 kg/ton of dry cellulose and said amount of said carbon dioxide feed, which is sufficient to achieve a substantial buffering effect, is from about 0.5 kg/ton to about 5 kg/ton of dry cellulose.

13. A process for stabilizing the pH of a pulp suspension at a desired pH level, comprising providing a papermaking pulp suspension and increasing the buffering ability of said paper making pulp suspension by adding to the circulation system of pulp and white water in the stock preparation of a paper machine in a paper mill, a combination of an alkali metal hydroxide feed and a carbon dioxide feed, which feeds cooperate to increase the pH of said pulp suspension and to otherwise only counter each other's PH adjusting effects without further separate uses of their respective intermediate pH adjusting effects, each of said feeds being added in an amount greater than what would be required to only adjust the pH of the suspension to the desired pH level, said feeds being provided in an amount sufficient to achieve a significant buffering effect of said pulp suspension and to increase the pH of said pulp suspension and maintain the pH at a desired level from the addition of the feeds throughout the short circulation and formation of the paper on the paper machine.

14. Process according to claim 13, wherein the step of providing said paper making pulp suspension includes adding water to bales of pulp or adding water to pulp of increased consistency coming from a pulp mill.

15. Process according to claim 13, wherein said amount of alkali metal hydroxide feed, which achieves a significant buffering, is a sodium hydroxide feed of from about 0.5 kg/ton to about 5 kg/ton of dry cellulose and said amount of carbon dioxide feed, which achieves a significant buffering, is equal to from about 0.5 kg/ton to about 5 kg/ton of dry cellulose.

16. A process for stabilizing the pH of a pulp suspension at a desired pH level, comprising providing a papermaking pulp suspension in a paper mill after a pulp mill and increasing the buffering ability of said pulp suspension by adding thereto, in the stock preparation of a paper machine in said paper mill, a combination of an alkali metal hydroxide feed and a carbon dioxide feed, which feeds cooperate to increase the pH of said pulp suspension and to otherwise only counter each other's pH adjusting effects without further separate uses of their respective intermediate pH adjusting effects, each of said feeds being added in an amount greater than what would be required to only adjust the pH of the suspension to the desired pH level, said feeds being provided in an amount sufficient to achieve a significant buffering effect of said pulp suspension and to increase the pH of said pulp suspension and maintain the pH at a desired level from the addition of the feeds throughout the short circulation and formation of the paper on the paper machine.

17. A process according to claim 16, wherein said feeds are added to the circulation of pulp and white water of said paper machine.

18. A process for producing paper comprising:

providing a paper making pulp suspension for processing in the stock preparation of a paper machine in a paper mill;

increasing the buffering ability of said pulp suspension by adding thereto in said stock preparation a combination of an alkali metal hydroxide feed and a carbon dioxide feed, which feeds cooperate to increase the pH of said pulp suspension and to otherwise only counter each other's pH adjusting effects without further separate uses of their respective intermediate pH adjusting effects, each of said feeds being provided in an amount greater than that required to only adjust the pH of the pulp suspension to a desired level, and said feeds being provided in an amount sufficient to achieve a substantial buffering effect of said pulp suspension and to increase the pH of said pulp suspension and maintain the pH at a desired level from the addition of the feeds throughout the short circulation and the formation of the pulp suspension into a web; and forming said pulp suspension into a web, and drying said web to form paper.

19. Process according to claim 18, characterized in that the pH of said pulp suspension is increased to a desired value between 7 and 9.

20. Process according to claim 1, further comprising the step of providing said pulp suspension for processing in the stock preparation of said paper machine in said paper mill, said pulp suspension being provided with an initial pH level lower than said desired pH level.

21. Process according to claim 20, wherein the step of providing said pulp suspension includes adding water to bales of pulp or adding water to pulp of increased consistency coming from a pulp mill.

22. Process according to claim 20, wherein said amount of alkali metal hydroxide feed which achieves a significant buffering effect is a sodium hydroxide feed equal to between 0.5 and 5 kg/ton dry cellulose and said amount of carbon dioxide feed which achieves a significant buffering effect is equal to between 0.5 and 5 kg/ton dry cellulose.

23. Process according to claim 18, wherein the step of providing said paper making pulp suspension includes adding water to bales of pulp or adding water to pulp of increased consistency coming from a pulp mill.

24. Process according to claim 18, wherein said amount of said alkali metal hydroxide feed, which is sufficient to achieve a substantial buffering effect, is a sodium hydroxide feed of from about 0.5 kg/ton to about 5 kg/ton of dry cellulose and said amount of said carbon dioxide feed, which is sufficient to achieve a substantial buffering effect, is from about 0.5 kg/ton to about 5 kg/ton of dry cellulose.

25. A process for producing paper comprising:

(a) adding water to bales of pulp or to pulp of increased consistency from a pulp mill to provide a paper making pulp suspension for processing in the stock preparation of a paper machine in a paper mill including short circulation and formation of the pulp suspension into a web;

(b) increasing the buffering ability of said pulp suspension in said stock preparation by adding thereto a combination of an alkali metal hydroxide feed and a carbon dioxide feed, which feeds cooperate to increase the PH of said pulp suspension and to otherwise only counter each other's pH adjusting effects without further separate uses of their respective intermediate pH adjusting effects, said feeds being provided in an amount greater than that required to only adjust the pH of the pulp suspension to a desired level, and said feeds being provided in an amount sufficient to achieve a substantial buffering effect of said pulp suspension and to increase the pH of said pulp suspension and maintain the pH at a desired level from the addition of the feeds throughout the short circulation and the formation of the pulp suspension into a web, and (c) forming said pulp suspension into a web, and drying said web to form paper.

26. Process according to claim 25, wherein the amount of said alkali metal hydroxide feed sufficient to achieve a substantial buffering effect is a sodium hydroxide feed of from about 0.5 kg/ton to about 5 kg/ton of dry cellulose and the amount of said carbon dioxide feed sufficient to achieve a substantial buffering effect is from about 0.5 kg/ton to about 5 kg/ton of dry cellulose.

* * * * *